US010173800B2

(12) United States Patent
Nagahara

(10) Patent No.: US 10,173,800 B2
(45) Date of Patent: Jan. 8, 2019

(54) LABEL PREPARING DEVICE AND LABEL PREPARING METHOD IN LABEL PREPARING DEVICE

(71) Applicant: SEIKO EPSON CORPORATION, Tokyo (JP)

(72) Inventor: Atsushi Nagahara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 14/863,473

(22) Filed: Sep. 24, 2015

(65) Prior Publication Data

US 2016/0083133 A1 Mar. 24, 2016

(30) Foreign Application Priority Data

Sep. 24, 2014 (JP) ..... 2014-193677

(51) Int. Cl.

*B65C 9/00* (2006.01)
*B31D 1/02* (2006.01)
*B65C 9/18* (2006.01)

(52) U.S. Cl.

CPC ..... *B65C 9/0015* (2013.01); *B31D 1/021* (2013.01); *B31D 1/026* (2013.01); *B31D 1/027* (2013.01); *B65C 2009/0084* (2013.01); *B65C 2009/1846* (2013.01)

(58) Field of Classification Search

CPC ..... B65C 9/0015; B31D 1/021; B31D 1/026; B31D 1/027

See application file for complete search history.

(56) References Cited

U.S. PATENT DOCUMENTS 4,544,824 A * 10/1985 Knutsson ..... A41H 43/0292 219/121.67
6,187,128 B1 2/2001 Oosterlinck
6,491,361 B1 * 12/2002 Spann ..... B41J 2/01 347/2
6,592,693 B1 * 7/2003 Nedblake ..... B23K 26/0846 156/247
2003/0165630 A1 * 9/2003 Baker ..... B41J 11/0015 118/244
2004/0250947 A1 * 12/2004 Phillips ..... B31D 1/021 156/250
2010/0053299 A1 * 3/2010 Govorkov ..... B31D 1/027 347/244
2012/0133698 A1 5/2012 Kato
2012/0242732 A1 * 9/2012 Nagahara ..... B41J 2/2132 347/14

(Continued)

FOREIGN PATENT DOCUMENTS

JP 2003-226313 8/2003
JP 2006-102989 A 4/2006

(Continued)

*Primary Examiner* — Daniel McNally
(74) *Attorney, Agent, or Firm* — Workman Nydegger

(57) ABSTRACT

There is provided a label preparing device including: a laser cutting section that forms a cutting line, which is an outline of a label piece, on a media by irradiating the media with laser beams; and a print section that applies ink to at least a peripheral part of the label piece after the cutting line is formed. It is preferable that the laser cutting section irradiates the media in an immobile state with laser beams, and the print section applies ink to the media in which the immobile state is maintained.

6 Claims, 17 Drawing Sheets

(56) References Cited

U.S. PATENT DOCUMENTS

| | | | | |
|---|---|---|---|---|
| 2014/0031189 | A1* | 1/2014 | Izawa ..... | B31D 1/026<br>493/324 |
| 2014/0071486 | A1 | 3/2014 | Van Bauwel | |
| 2014/0292841 | A1 | 10/2014 | Nagahara | |
| 2014/0292983 | A1 | 10/2014 | Nagahara | |
| 2014/0295055 | A1 | 10/2014 | Nagahara | |

FOREIGN PATENT DOCUMENTS

| | | | |
|---|---|---|---|
| JP | 2011-230338 | A | 11/2011 |
| JP | 2012-116066 | A | 6/2012 |
| JP | 2014-053009 | | 3/2014 |
| JP | 2014-069938 | A | 4/2014 |
| JP | 2014-188934 | | 10/2014 |
| JP | 2014-188935 | | 10/2014 |
| JP | 2014-188957 | | 10/2014 |
| JP | 2014-191707 | | 10/2014 |

* cited by examiner

LABEL PREPARING DEVICE AND LABEL PREPARING METHOD IN LABEL PREPARING DEVICE

BACKGROUND

1. Technical Field

The present invention relates to a label preparing device which prepares a printed label by performing laser cutting and applying ink to a media, and a label preparing method in the label preparing device.

2. Related Art

In the related art, a label manufacturing device (refer to JP-A-2003-226313) is known which includes a laser cutting mechanism that forms a cutting line which is the outline of a label on a label connection body by irradiating the label connection body with laser beams, and a thermal head that performs printing on the label connection body.

The inventors found the problem below.

When the label preparing device forms a cutting line by irradiating a media with laser beams, inclined surfaces (hereinafter, referred to as a "peripheral inclined surfaces"), which have an approximately "V" sectional shape that is open toward a laser beam radiation side, are formed on both the sides of the cutting line on the media due to the intensity distribution of laser beams. When the label preparing device performs laser cutting after applying ink to the media, ink is not applied to the peripheral inclined surfaces. Therefore, it is difficult for the label preparing device to prepare a label piece which has colored peripheral parts.

SUMMARY

An advantage of some aspects of the invention is to provide a label preparing device which is capable of preparing a label piece which has colored peripheral parts, and a label preparing method in the label preparing device.

According to an aspect of the invention, there is provided a label preparing device including: a laser cutting section that forms a cutting line, which is an outline of a label piece, on a media by irradiating the media with laser beams; and a print section that applies ink to at least a peripheral part of the label piece after the cutting line is formed.

According to another aspect of the invention, there is provided a label preparing method in a label preparing device including: forming a cutting line, which is an outline of a label piece, on a media by irradiating the media with laser beams; and applying ink to at least a peripheral part of the label piece after the cutting line is formed.

According to the aspect of the invention, the label preparing device applies ink to the peripheral parts of the label piece, that is, the peripheral inclined surfaces which are formed through laser irradiation after the cutting line is formed. Therefore, peripheral inclined surfaces are colored by ink. Accordingly, it is possible for the label preparing device to prepare the label piece in which the peripheral parts are colored.

In the label preparing device, it is preferable that the laser cutting section irradiates the media in an immobile state with laser beams, and the print section applies ink to the media in which the immobile state is maintained.

According to the aspect of the invention, the label preparing device applies ink to the media in an immobile state after laser cutting is performed on the media in the immobile state. Therefore, it is possible for the label preparing device to appropriately apply ink to the peripheral parts of the label piece without detecting a position where the label piece is formed.

In this case, it is preferable that the label preparing device further includes a platen on which the media in the immobile state is placed, in which the laser cutting section forms the cutting line on the media, which includes a label connection body and a liner which is affixed to the label connection body, such that the label connection body is cut and the liner is not cut.

According to the aspect of the invention, laser beams are prevented from passing through the media and being irradiated to the platen. Therefore, it is possible for the label preparing device to prevent the platen from being damaged when the media is irradiated with laser beams.

In this case, it is preferable that the label preparing device further includes a data acquisition unit that acquires print data; and a print data processing unit that processes the print data such that a print density of the peripheral part of the label piece increases, in which the print section applies ink to the media based on the processed print data.

If the label preparing device applies ink according to original print data when the peripheral inclined surfaces, which are formed through laser irradiation, have bad placement of ink compared to the print surface of the media, the print density of the peripheral inclined surfaces, that is, the peripheral parts of the label piece is lower than an assumed density.

In contrast, according to the aspect of the invention, the label preparing device applies ink to the media based on the print data which is processed such that the print density of the peripheral parts of the label piece increases. Therefore, even when the peripheral inclined surfaces have bad placement of ink compared to the print surface of the media, it is possible for the label preparing device to color the peripheral parts of the label piece at an appropriate print density.

In this case, it is preferable that the print section applies pre-coating liquid for forming a pre-coated layer, which accommodates ink, to at least the peripheral part of the label piece after the label piece is formed by the laser cutting section and before ink is applied to the media.

When the label preparing device performs laser cutting on the media on which the pre-coated layer is formed, the pre-coated layer is removed from the peripheral inclined surfaces, which are formed through laser irradiation, that is, the peripheral parts of the label piece. Therefore, the label preparing device applies ink to the peripheral parts of the label piece in a state in which the pre-coated layer is not present. Since an area, in which the pre-coated layer is not present, has bad placement of ink, the peripheral parts of the label piece are not appropriately colored.

In contrast, according to the aspect of the invention, the label preparing device applies the pre-coating liquid to at least the peripheral parts of the label piece after performing laser cutting. Therefore, the label preparing device applies ink to the peripheral parts of the label piece in a state in which the pre-coated layer is formed. Accordingly, it is possible for the label preparing device to appropriately color the peripheral parts of the label piece.

BRIEF DESCRIPTION OF THE DRAWINGS

The invention will be described with reference to the accompanying drawings, wherein like numbers reference like elements.

FIGS. 5A to 5C are diagrams illustrating a process of preparing a printed label in the label preparing device, of which FIG. 5A illustrates a process before laser cutting is performed, FIG. 5B illustrates a laser cutting process, and FIG. 5C illustrates a printing process.

FIGS. 6A to 6C are sectional diagrams illustrating a media on which a cutting line is formed by the label preparing device, of which FIG. 6A illustrates a media acquired before the laser cutting process is performed, FIG. 6B illustrates the media acquired when the laser cutting process is performed, and FIG. 6C illustrates a media acquired when the printing process is performed.

FIGS. 7A to 7C are diagrams illustrating a process of preparing a printed label in a label preparing device according to a related technology, of which FIG. 7A illustrates a process before the printing process is performed, FIG. 7B illustrates a printing process, and FIG. 7C illustrates a laser cutting process.

FIGS. 8A to 8C are sectional diagrams illustrating a media on which a cutting line is formed by the label preparing device according to the related technology, of which FIG. 8A illustrates a media acquired before the printing process is performed, FIG. 8B illustrates a media acquired when the printing process is performed, and FIG. 8C illustrates a media acquired when the laser cutting process is performed.

FIGS. 12A to 12D are diagrams illustrating a process of preparing a printed label in the label preparing device according to the modification example, of which FIG. 12A illustrates a process before a laser cutting process is performed, FIG. 12B illustrates a laser cutting process, FIG. 12C illustrates a pre-coating liquid applying process, and FIG. 12D illustrates a printing process.

FIGS. 13A to 13D are sectional diagrams illustrating a media on which a cutting line is formed by the label preparing device according to the modification example, of which FIG. 13A illustrates a media acquired before the laser cutting process is performed, FIG. 13B illustrates the media acquired when the laser cutting process is performed, FIG. 13C illustrates a media on which the pre-coating liquid applying process is performed, and FIG. 13D illustrates a media acquired when the printing process is performed.

FIGS. 14A to 14D are diagrams illustrating a process of preparing the printed label in the label preparing device according to the related technology, of which FIG. 14A illustrates a process before the pre-coating liquid applying process is performed, FIG. 14B illustrates the pre-coating liquid applying process, FIG. 14C illustrates a laser cutting process, and FIG. 14D illustrates a printing process.

FIGS. 15A to 15D are sectional diagrams illustrating a media on which a cutting line is formed by the label preparing device according to the related technology, of which FIG. 15A illustrates a media acquired before the pre-coating liquid applying process is performed, FIG. 15B illustrates a media acquired when the pre-coating liquid applying process is performed, FIG. 15C illustrates a media acquired when the laser cutting process is performed, and FIG. 15D illustrates a media acquired when the printing process is performed.

FIGS. 17A and 17B are photographs of a media on which the cutting line is formed, of which FIG. 17A is a photograph which is acquired by imaging the periphery of the cutting line from the side of a print surface, and FIG. 17B is a sectional photograph of the media in the peripheral of the cutting line.

DESCRIPTION OF EXEMPLARY EMBODIMENTS

Hereinafter, a label preparing device according to one embodiment of the invention will be described with reference to the accompanying drawings. The label preparing device according to the embodiment prepares a printed label by applying ink to a media which is fed in a roll-to-roll manner.

First, the media will be described.

Figure 1:
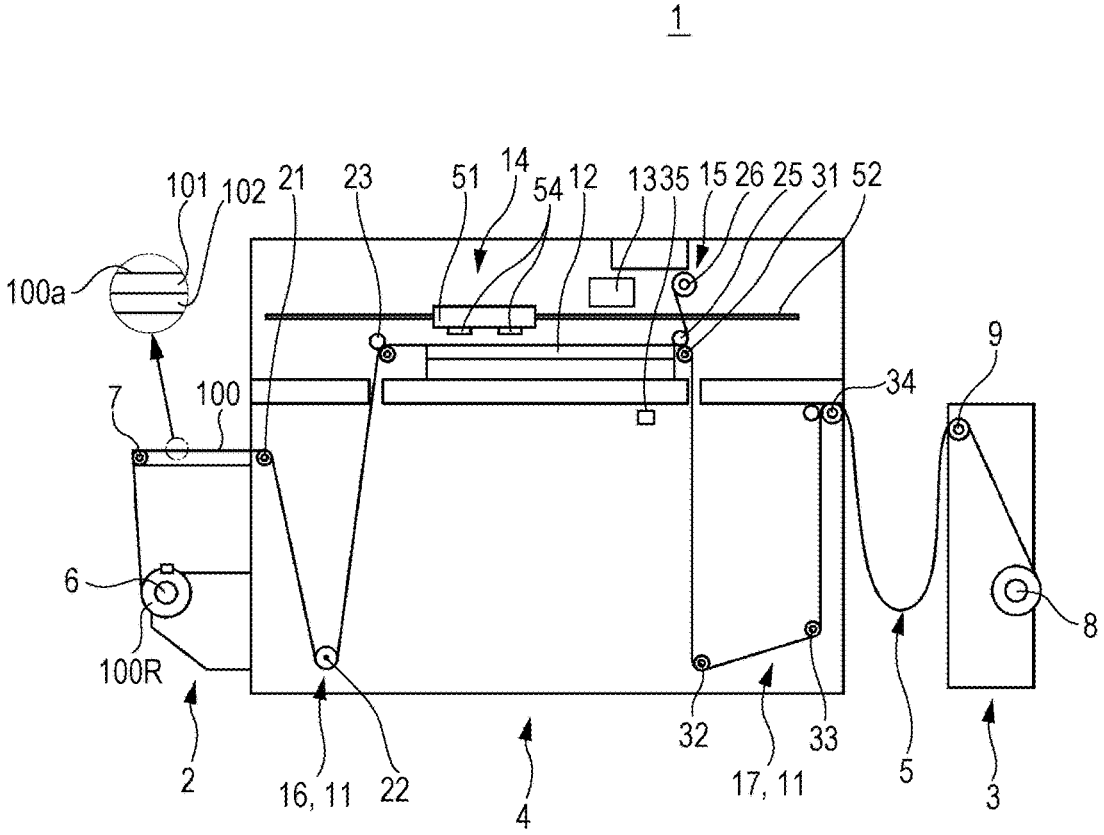
FIG. 1 is a diagram illustrating the configuration of a label preparing device according to an embodiment of the invention.

As illustrated in FIG. 1, a media 100 has a long belt-shaped sheet shape. The media 100 includes a label connection body 101 and a liner 102. The liner 102 is releasably affixed to the adhesive surface of the label connection body 101. The media 100 is set for a label preparing device 1 as a label roller 100R which is wound in a roller shape with the label connection body 101 on the outside. Meanwhile, the material of the label connection body 101 is not particularly limited, and it is possible to use various types of materials such as paper and a resin film.

Subsequently, the label preparing device 1 will be described.

The label preparing device 1 includes a delivering section 2, a winding section 3, and a media processing unit 4. In addition, a buffer section 5 is provided between the winding section 3 and the media processing unit 4. The media 100, which is fed from the media processing unit 4, is temporarily stored in the buffer section 5.

The delivering section 2 includes a delivering shaft 6 and a delivery-side intermediate roller 7. The delivering shaft 6 delivers the set label roller 100R, and rotatably supports the label roller 100R. The media 100, which is fed from the label roller 100R, is transmitted to the media processing unit 4 through the delivery-side intermediate roller 7.

The winding section 3 includes a winding shaft 8 and a winding-side intermediate roller 9. The winding shaft 8 winds the media 100, which is fed from the media processing unit 4 through the winding-side intermediate roller 9, in a roller shape. The winding shaft 8 is rotatably driven by a winding shaft driving section which is not shown in the drawing. More specifically, the drive of the winding shaft 8 is controlled based on the result of detection of the slack position of the media 100 in the buffer section 5.

The media processing unit 4 includes a media feed section 11, a platen 12, a laser cutting section 13, a print section 14, and a leaving lift section 15.

The media feed section 11 includes an upstream roller group 16 and a downstream roller group 17. The upstream roller group 16 and the downstream roller group 17 are respectively provided upstream and downstream while interposing the platen 12 therebetween.

The upstream roller group 16 feeds the media 100, which is fed from the delivering section 2, to the platen 12. The upstream roller group 16 sequentially includes a first upstream-side roller 21, a second upstream-side roller 22, and a pair of upstream rollers 23 from the upstream side. The first upstream-side roller 21 and the second upstream-side roller 22 perform slave rotation according to the feeding of the media 100. The rotation of the pair of upstream rollers 23 is driven by an upstream feed driving section which is not shown in the drawing. The meandering or the like of the media 100 is corrected by an approximately "V"-shaped feed path which is formed by the first upstream-side roller 21, the second upstream-side roller 22, and the pair of upstream rollers 23.

The downstream roller group 17 feeds the media 100, which is transmitted from the platen 12, to the winding section 3. The downstream roller group 17 sequentially includes a first downstream-side roller 31, a second downstream-side roller 32, a downstream third roller 33, and a pair of downstream rollers 34 from the upstream side. The first downstream-side roller 31, the second downstream-side roller 32, and the downstream third roller 33 performs slave rotation according to the feeding of the media 100. The rotation of the pair of downstream rollers 34 is driven by a downstream feed driving section which is not shown in the drawing. The meandering or the like of the media 100 is corrected by an approximately "U"-shaped feed path which is formed by the first downstream-side roller 31, the second downstream-side roller 32, the downstream third roller 33, and the pair of downstream rollers 34.

In the media feed section 11 which is configured as described above, when laser cutting is completely performed on the media 100 on the platen 12 and ink A (refer to FIGS. 5A to 5C) is applied to the media 100 as much as a unit area, the pair of upstream rollers 23 and the pair of downstream rollers 34 are approximately synchronized and rotated. Therefore, the media 100, on which laser cutting is performed and to which ink A is applied as much as the unit area, is fed from the platen 12 to the downstream side of the platen 12. In addition, at the same time, the media 100, on which laser cutting is not performed and to which ink A is not applied as much as the unit area, is fed to the platen 12 from the upstream side of the platen 12.

The upper surface of the platen 12 is set to an area in which laser cutting is performed on the media 100 and ink A is applied to the media 100. A plurality of suction holes (not shown in the drawing), which are connected to a suction fan 35, are provided on the upper surface of the platen 12. The suction fan 35 is driven when the operation of the media feed section 11 stops. Therefore, the media 100 is adsorbed onto the upper surface of the platen 12, and thus the media 100 becomes to be in an immobile state. In contrast, the drive of the suction fan 35 stops when the media feed section 11 is operated. Therefore, the adsorption of the media 100 of the upper surface of the platen 12 is released, and thus the feeding of the media 100 is permitted.

The laser cutting section 13 forms a cutting line 103, which is the outline of a label piece 104, on the media 100 (refer to FIGS. 5A to 5C) by irradiating the media 100, which is adsorbed onto the upper surface of the platen 12, with laser beams from the side of the print surface 100*a*. The laser cutting section 13 forms the cutting line 103 on the media 100 by performing half cutting on the media 100, that is, by cutting the label connection body 101 while not cutting the liner 102.

Figure 2:
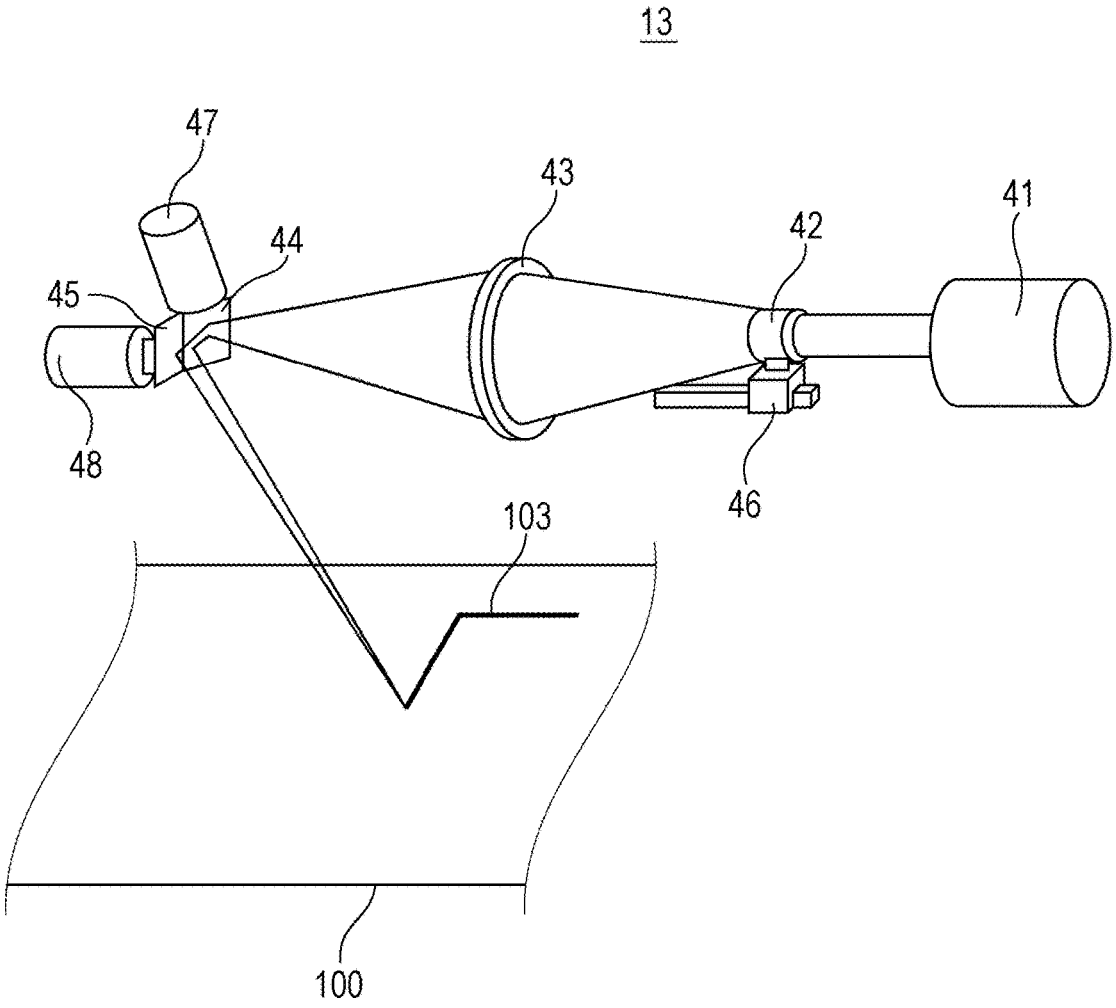
FIG. 2 is a diagram illustrating the configuration of a laser cutting section.

As illustrated in FIG. 2, the laser cutting section 13 allows laser beams to scan the media 100 using a galvano method. The laser cutting section 13 includes an oscillator 41, a first lens 42, a second lens 43, a first mirror 44, a second mirror 45, a first lens moving section 46, a first motor 47, and a second motor 48.

The oscillator 41 oscillates laser beams. It is possible to use carbon dioxide gas laser, YAG laser, or the like as the oscillator 41. Laser beams, which are emitted from the oscillator 41, are incident to the second lens 43 after the diameters of the beams are enlarged by the first lens 42. The second lens 43 emits laser beams such that the laser beams are converged at one point on the media 100. The laser beams, which are emitted from the second lens 43, are reflected in the first mirror 44 and the second mirror 45, and thus the media 100 is irradiated with the laser beams.

The first lens moving section 46 causes the first lens 42 to move along the optical axes of the laser beams. Therefore, the distance between the first lens 42 and the second lens 43 changes, and thus it is possible to adjust the focal distance of the laser beams. Meanwhile, the first lens moving section 46 includes, for example, a stepping motor as a driving source.

The first motor 47 rotates the first mirror 44, thereby changing the angle thereof. In addition, the second motor 48 rotates the second mirror 45, thereby changing the angle thereof. It is possible to use, for example, a stepping motor, as the first motor 47 and the second motor 48. The laser cutting section 13 causes laser beams to scan the media 100 two-dimensionally by changing the angles of the first mirror 44 and the second mirror 45. Meanwhile, laser beams may be caused to scan using an X-Y plotter method instead of the galvano method.

As illustrated in FIG. 1, the print section 14 applies ink A to the media 100 which is adsorbed on the upper surface of the platen 12. The print section 14 includes a carriage 51, an X-axial table 52, and a Y-axial table (not shown in the drawing). A plurality of recording heads 54 are mounted on the carriage 51. The recording heads 54 ejects, for example, four-colored CMYK ink A. It is possible to appropriately use ink jet heads as the recording heads 54. The X-axial table 52 causes the carriage 51 to move in the X-axial direction which is the direction in which the media 100 is fed. The Y-axial table is mounted on the X-axial table 52, and causes the carriage 51 to move in the Y-axial direction which is perpendicular to the X-axial direction in a horizontal plane.

The print section 14, which is configured as described above, prints an image on the media 100 in such a way that the recording heads 54, which are mounted on the carriage 51, move in the X-axial direction and the Y-axial direction by the X-axial table 52 and the Y-axial table and discharge ink A to the print surface 100*a* of the media 100 which is adsorbed on the platen 12.

Figure 3:
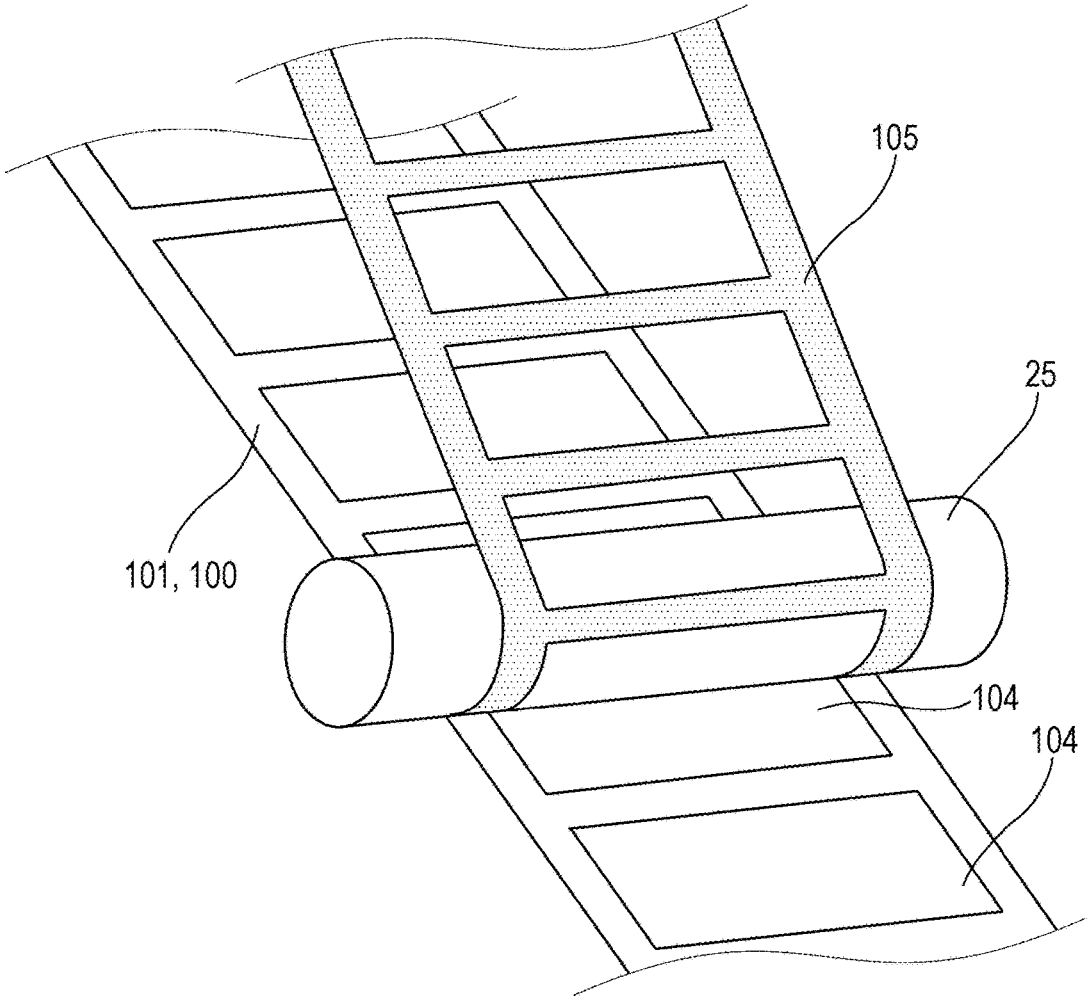
FIG. 3 is a perspective diagram illustrating a leaving lift section.

The leaving lift section 15 is provided on the downstream side of the platen 12. The leaving lift section 15 includes a leaving lift roller 25 and a leaving shaft 26. A label leaving 105 (refer to FIG. 3) is peeled off from the liner 102 by the leaving lift roller 25. The peeled-off label leaving 105 is wound around the leaving lift shaft 26.

Figure 4:
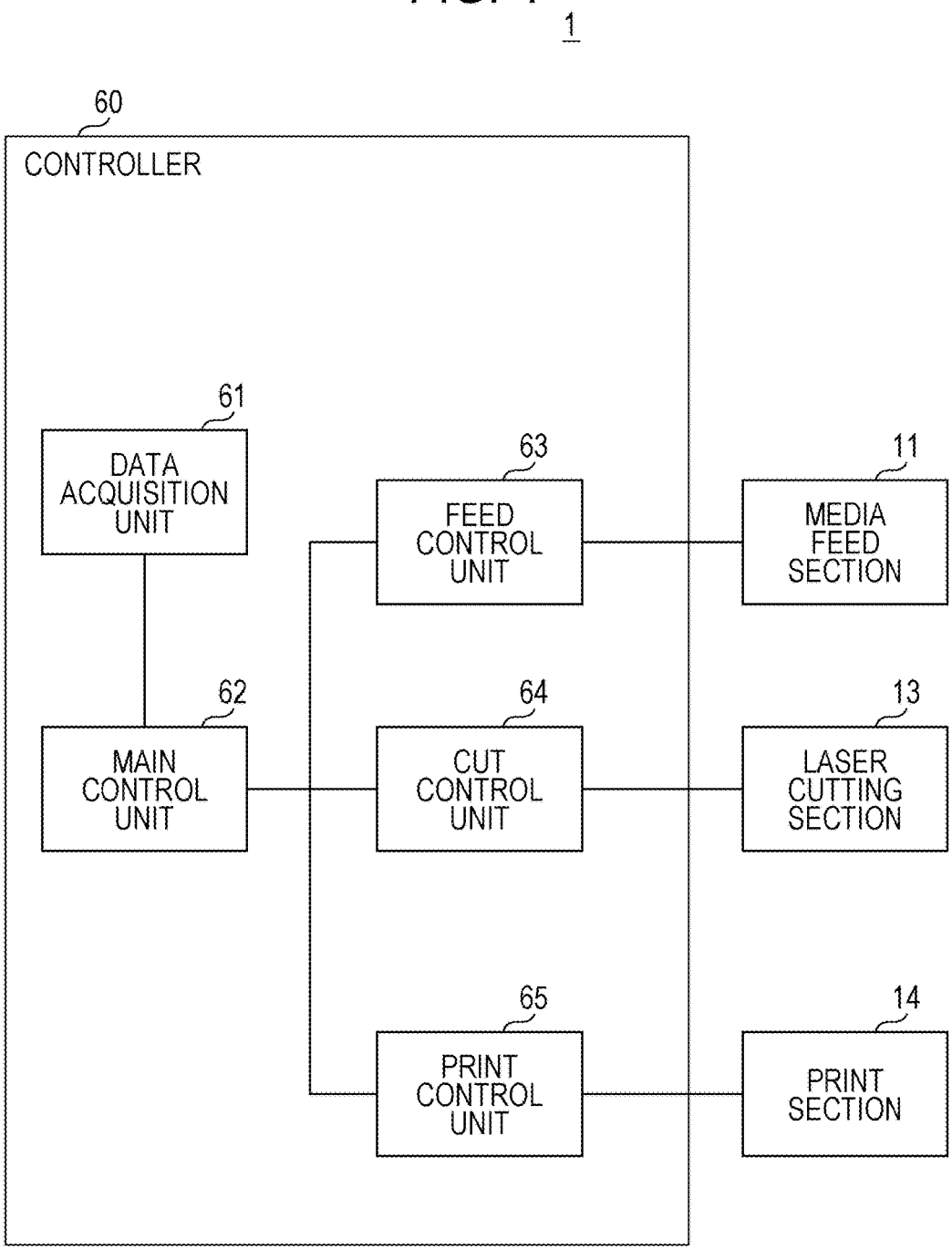
FIG. 4 is a control block diagram illustrating the label preparing device.

The control system of the label preparing device 1 will be described with reference to FIG. 4. The label preparing device 1 includes a controller 60 in addition to the media feed section 11, the laser cutting section 13 and the print section 14.

The controller 60 includes a Central Processing Unit (CPU), a Read Only Memory (ROM), and a Random Access Memory (RAM) which are not shown in the drawing. The CPU of the controller 60 loads a program from the ROM and executes the program using the RAM, and controls the entire operation of the label preparing device 1.

The controller 60 includes a data acquisition unit 61, a main control unit 62, a feed control unit 63, a cut control unit 64, and a print control unit 65. At least a part of the functional units is realized in such a way that a prescribed program is executed by the controller 60.

The data acquisition unit 61 acquires cut data and print data. The cut data is used to form a star-shaped cutting line 103 (refer to FIG. 5B). In addition, the print data is used to apply ink A to a star shape, which has the same size as the cutting line 103, and to print the star shape (refer to FIG. 5D). The cut data is processed up to a state which can be used in the laser cutting section 13. Similarly, a half-tone process or the like is performed on the print data, and the print data is processed up to a state which can be used in the print section 14.

The main control unit 62 controls the feed control unit 63, the cut control unit 64, and the print control unit 65 such that a printed label 106 is prepared to a number which is specified by the user.

After laser cutting and applying of ink A are performed, the feed control unit 63 controls the media feed section 11 such that the media 100 is transmitted as much as the unit area. The cut control unit 64 controls the laser cutting section 13 based on the cut data. The print control unit 65 controls the print section 14 based on the print data.

An order in which the label preparing device 1 prepares the printed label 106 on the media 100 will be described in detail with reference to FIGS. 5A to 5C and FIGS. 6A to 6C. Meanwhile, here, the label connection body 101 has a single layer structure (refer to FIGS. 6A to 6C). However, the label connection body 101 may have a laminated structure as will be described later.

Figure 5A:
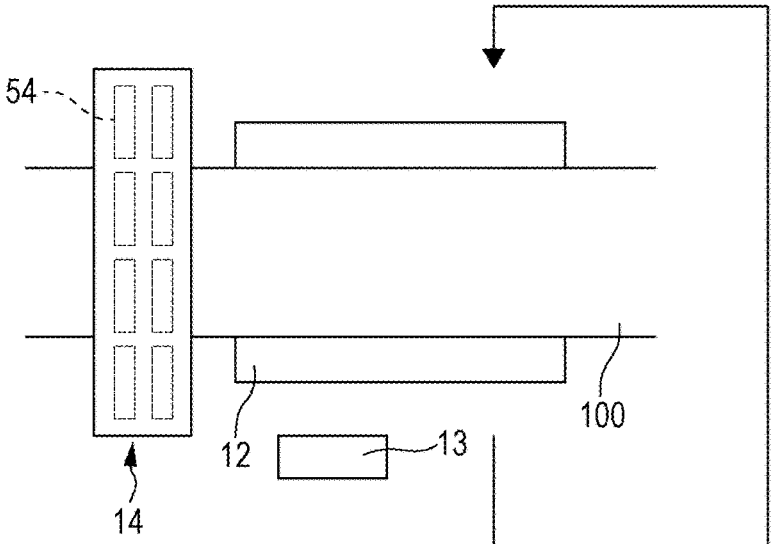
Figure 5B:
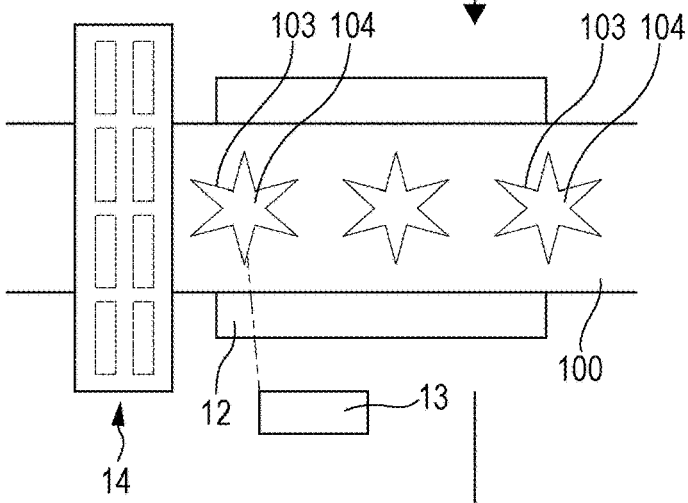

As illustrated in FIG. 5A, it is assumed that the media 100, on which the laser cutting and the applying of ink A are not performed, is fed to the platen 12 at a point in time in which the label preparing device 1 starts to prepare the printed label 106. When the preparation of the printed label 106 starts based on the operation of a user in the label preparing device 1, the laser cutting section 13 forms the cutting line 103 which is the outline of the label piece 104 on the media 100 by irradiating the media 100, which is adsorbed on the platen 12, with laser beams, as illustrated in FIG. 5B. Here, on both sides of the cutting line 103, peripheral inclined surfaces 101*a*, which have an approximately "V" sectional shape that is open toward the laser beam radiation side, that is, the side of the print surface 100*a*, are formed in the label connection body 101 due to the intensity distribution of laser beams (refer to FIG. 6B).

Figure 5C:
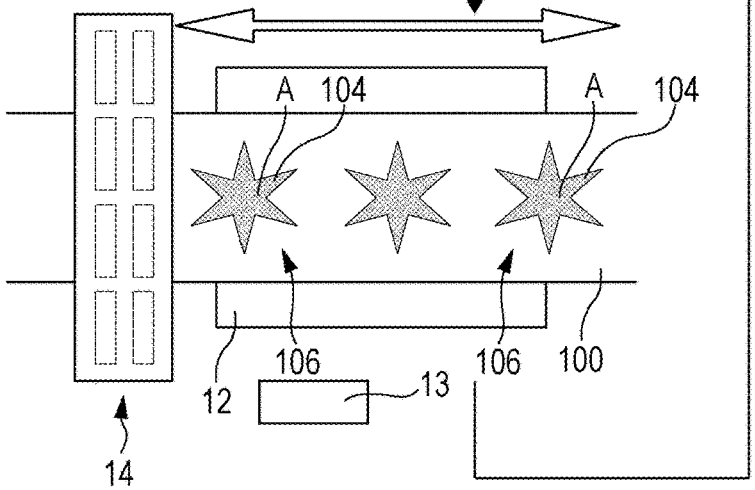
Figure 6A:
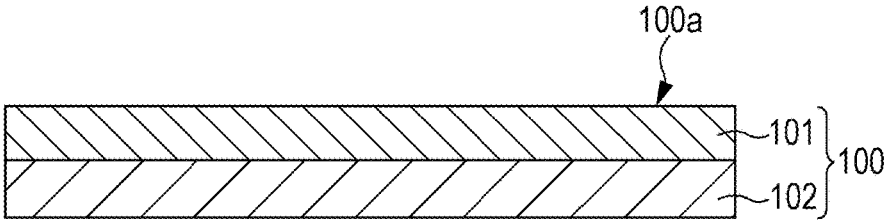
Figure 6B:
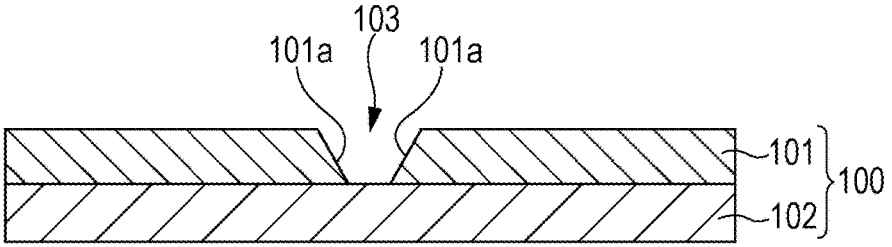
Figure 6C:
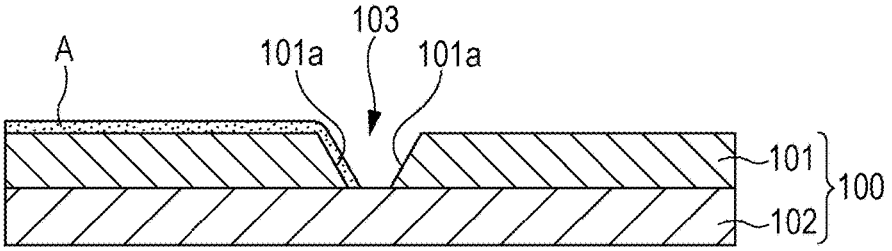
Figures 7A, 7B, 7C:
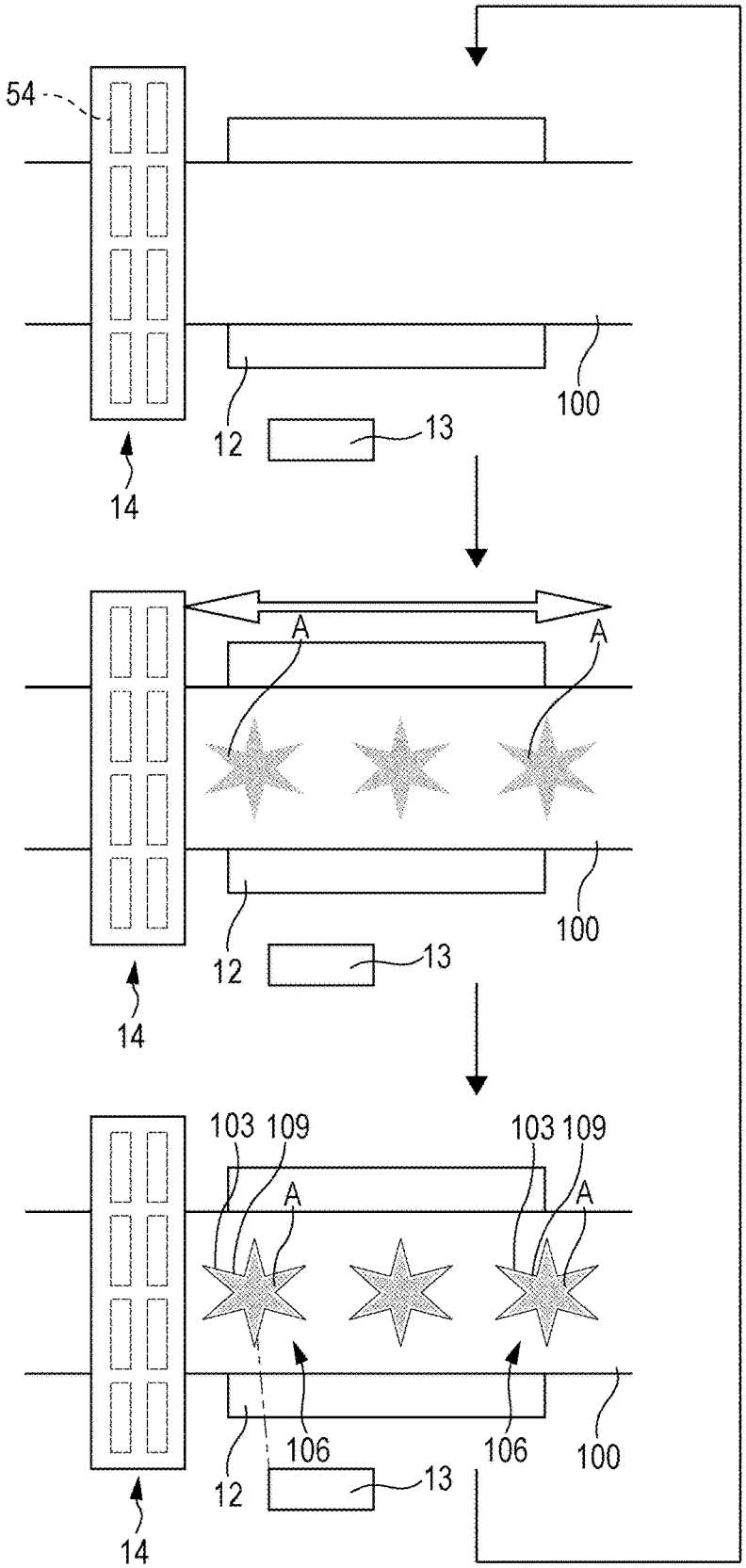
Figure 8A:
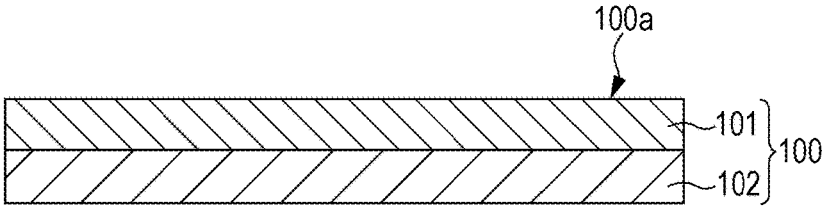
Figure 8B:
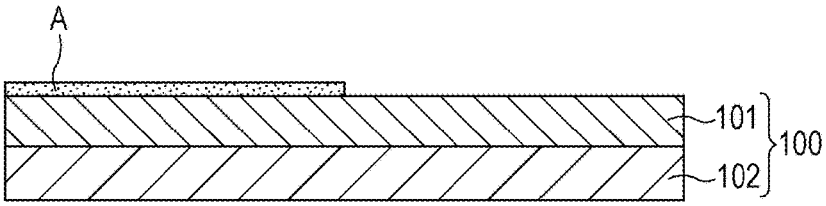
Figure 8C:
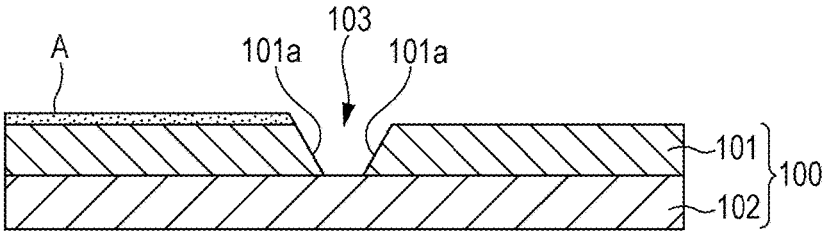

Subsequently, in the label preparing device 1, the print section 14 applies ink A to the media 100 which is adsorbed on the platen 12, as illustrated in FIG. 5C. Therefore, the printed label 106 is formed. Here, as described above, the print data is used to apply ink A in the same start shape as the cutting line 103, and thus ink A is applied to the label piece 104 while including the peripheral parts thereof. That is, ink A is applied to the peripheral inclined surfaces 101*a* which are formed through laser irradiation (refer to FIG. 6C).

Thereafter, in the label preparing device 1, the media feed section 11 transmits the media 100 as much as the unit area. Therefore, as illustrated in FIG. 5A, the media 100, on which the laser cutting and the applying of ink A are not performed, is fed to the platen 12 again. The label preparing device 1 repeatedly performs the above respective operations, that is, feeding of the media 100 (refer to FIG. 5A), laser cutting performed on the media 100 (refer to FIG. 5B), and applying of ink A to the media 100 (refer to FIG. 5C) until the printed label 106 is prepared to a number specified by the user.

A case, in which the label preparing device 1 performs laser cutting (refer to FIG. 7C) after applying ink A to the media 100 (refer to FIG. 7B) unlike the embodiment, will be described with reference to FIGS. 7A to C and FIGS. 8A to 8C. In this case, ink A is not applied to the peripheral inclined surfaces 101*a* which are prepared through the laser irradiation (refer to FIG. 8C). Therefore, it is difficult for the label preparing device 1 to prepare the label piece 104 on which the peripheral parts are colored. In other words, when the user observes the printed label 106 from the side of the print surfaces 100*a*, the original color of the peripheral inclined surfaces 101*a* which are formed through laser irradiation, that is, the color of the label connection body 101 is seen in the peripheral parts of the label piece 104 instead of the color of ink A which is applied to the print surface 100*a*. For example, when the original color of the label connection body 101 is white, a white margin 109 is generated in the prepared printed label 106 (refer to FIG. 7C).

Description will be made more specifically with reference to photographs illustrated in FIGS. 17A and 17B.

Figure 17A:
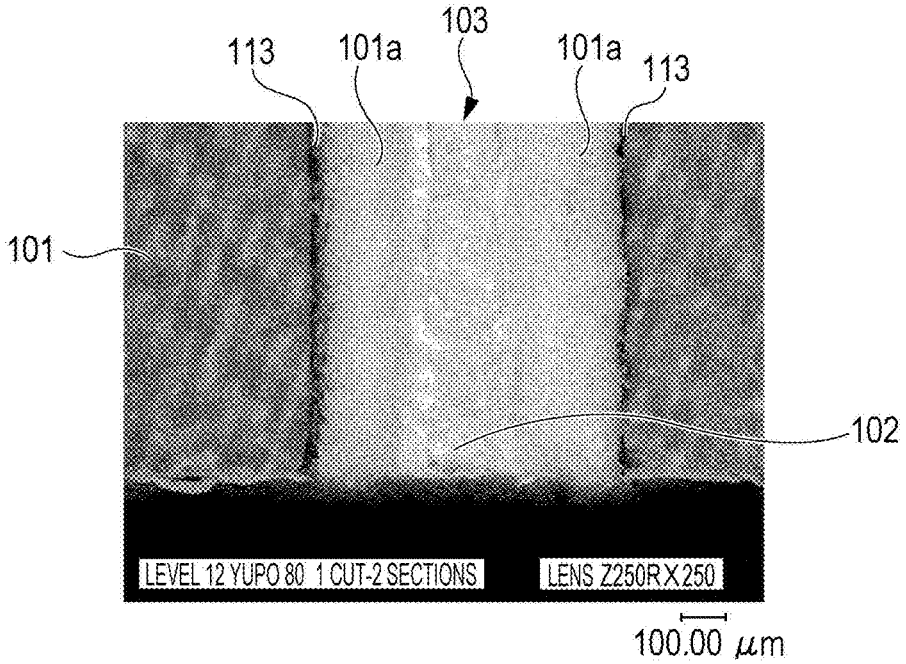
Figure 17B:
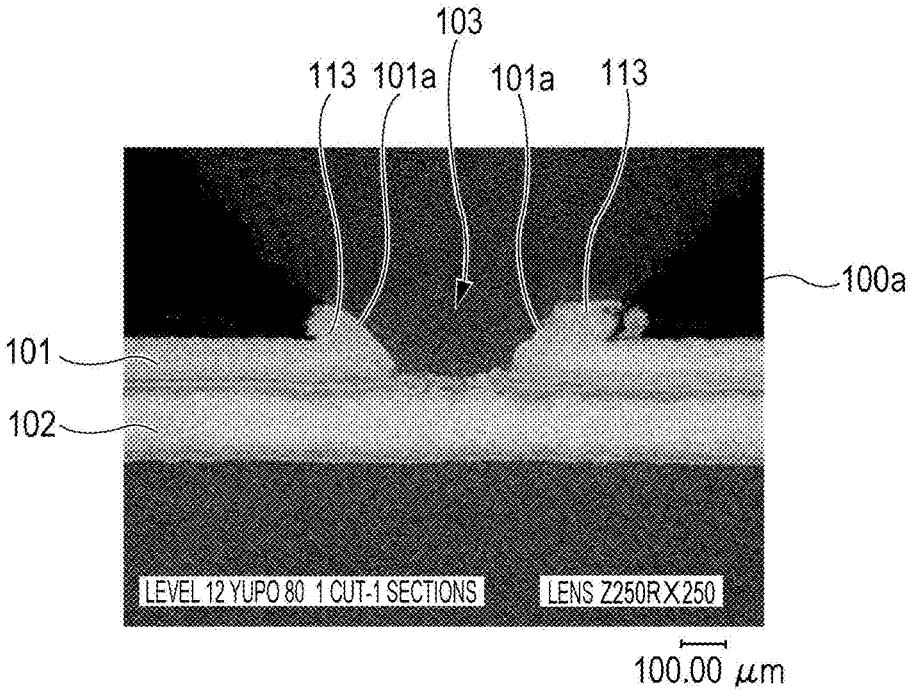

The photographs illustrated in FIGS. 17A and 17B include photographs of the media 100 on which the cutting line 103 is formed by irradiating the media 100, in which the print surface 100*a* is colored by the blue ink A in advance, with laser beams from the side of the print surface 100*a*, that is, a photograph in which the periphery of the cutting line 103 is imaged from the side of the print surface 100*a* (refer to FIG. 17A) and a photograph of the cross section of the periphery of the cutting line 103 of the media 100 (refer to FIG. 17B). A resin film system (product name "YUPO 80 (UV)", Lintec Corporation) is used as the label connection body 101 ("YUPO" is a registered trademark).

Meanwhile, diagrams in which the photographs illustrated in FIGS. 17A and 17B are colored, are submitted in an article document. The article document is referred to as necessary.

As understood with reference to FIGS. 17A and 17B, when the media 100 is irradiated with laser beams from the side of the print surface 100*a*, swellings 113, which protrude to the side of the print surface 100*a*, are formed on both sides of the cutting line 103 along the cutting line 103. In addition, the peripheral inclined surfaces 101*a*, which has a cross section of an approximately "V" shape that is open toward the side of the print surface 100*a*, are formed on both sides of the cutting line 103. The peripheral inclined surfaces 101*a* shows the original color (here, white) of the label connection body 101.

In contrast, the label preparing device 1 according to the embodiment applies ink A to the peripheral parts of the label piece 104, that is, peripheral inclined surfaces 101*a* which are formed through laser irradiation after performing laser cutting on the media 100, as described above. Therefore, the peripheral inclined surfaces 101*a* are colored by ink A. Therefore, it is possible for the label preparing device 1 to prepare the label piece 104 which has the colored peripheral parts.

The label preparing device 1 according to the embodiment performs laser cutting on the media 100 in a state being adsorbed on the platen 12, that is, the media 100 in an immobile state, and then applies ink A to the media 100 in a state being adsorbed on the platen 12, that is, in a state in which the immobile state is maintained. Therefore, it is possible for the label preparing device 1 to appropriately apply ink A to the peripheral parts of the label piece 104 without detecting a position where the label piece 104 is formed.

In the label preparing device 1 according to the embodiment, the laser cutting section 13 performs half cutting on the media 100. Therefore, laser beams are prevented from passing through the media 100 and being irradiated to the upper surface of the platen 12. Therefore, it is possible for the label preparing device 1 to prevent the upper surface of the platen 12 from being damaged when the media 100 is irradiated with laser beams.

Meanwhile, it is apparent that the invention is not limited to the above-described embodiment and various configurations are possible without departing from the gist of the invention. For example, it is possible to change the embodiment to the following forms.

The label preparing device 1 may apply ink A to the media 100 based on the print data which is processed such that the print density of the peripheral parts of the label piece 104 increases.

Figure 9:
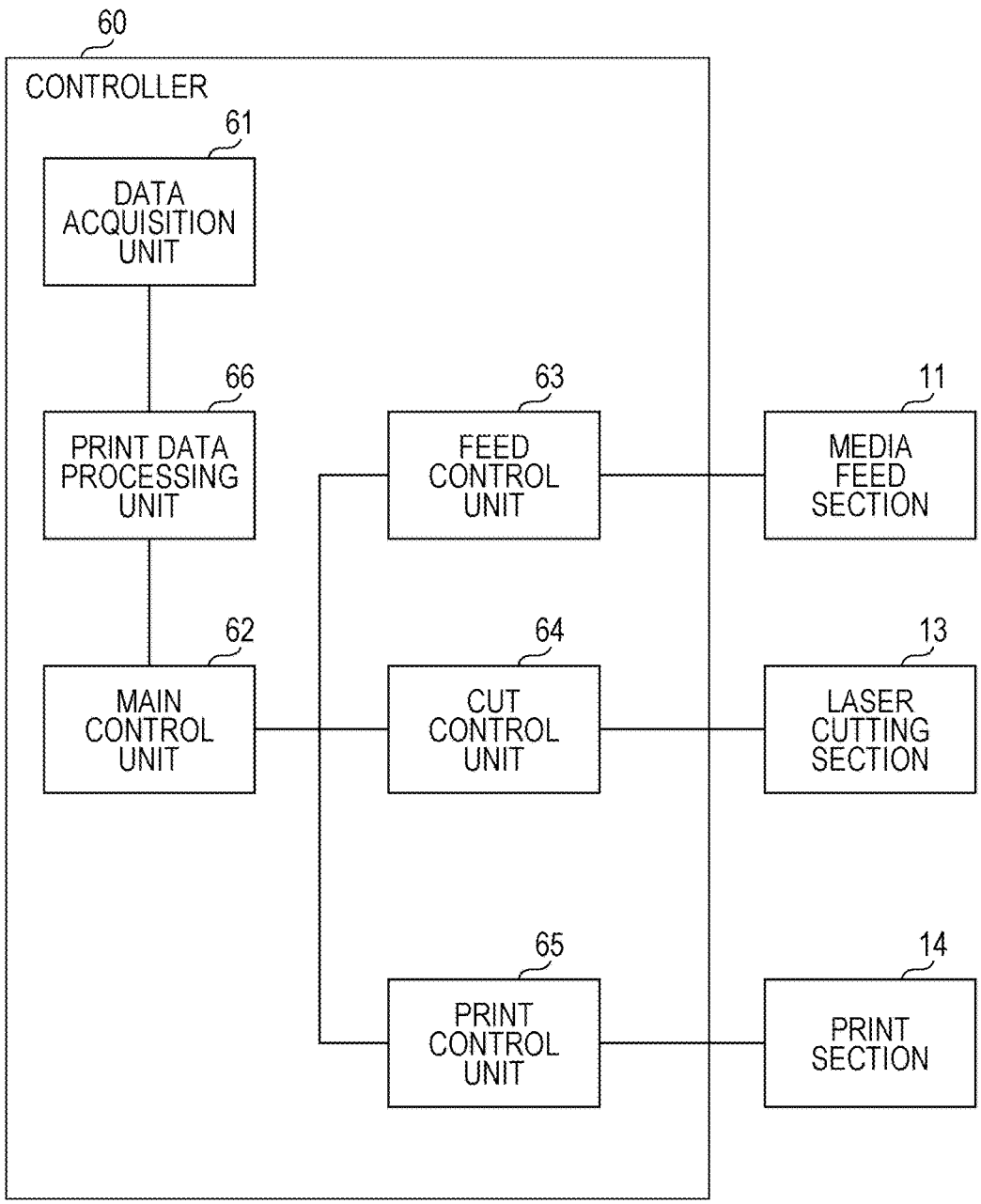
FIG. 9 is a control block diagram illustrating a label preparing device according to a modification example.

In a modification example, as illustrated in FIG. 9, the controller 60 includes a print data processing unit 66 in addition to the data acquisition unit 61, the main control unit 62, the feed control unit 63, the cut control unit 64, and the print control unit 65 which are described above. The data acquisition unit 61 acquires bit map data as the print data. The print data processing unit 66 processes the print data such that the print density of the peripheral parts of the label piece 104 increases.

Figure 10A:
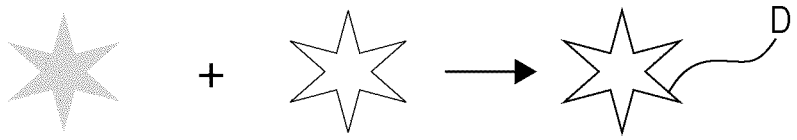
FIGS. 10A to 10C are diagrams illustrating an order that the label preparing device according to the modification example processes print data.
Figure 10B:
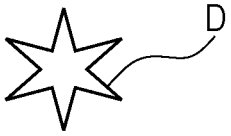
Figure 10C:
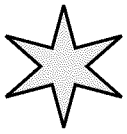

An order that the print data processing unit 66 processes the print data will be described with reference to FIGS. 10A to 10C. First, the print data processing unit 66 superimposes the cut data on the print data, and extracts an overlapped part D in which the cut data overlaps with the print data (refer to FIG. 10A). Subsequently, the print data processing unit 66 causes the overlapped parts D to be thicken (refer to FIG. 10B) according to a prescribed overlap value (for example, two pixels). Subsequently, the print data processing unit 66 processes the print data (refer to FIG. 10C) such that the print density of the overlapped part D becomes a prescribed density value (for example, increase of 10%). Thereafter, the print data processing unit 66 performs a half-tone process or the like on the print data, and generates binarized print data.

As described above, the label preparing device 1 according to the modification example applies ink A to the media 100 based on the print data which is processed such that the print density of the peripheral part of the label piece 104 increases. Therefore, even when the peripheral inclined surfaces 101*a*, which are formed through laser irradiation, has bad placement of ink A compared to the print surface 100*a* of the media 100, it is possible for the label preparing device 1 to color the peripheral inclined surfaces 101*a*, that is, the peripheral parts of the label piece 104 with appropriate print density. For example, if the label preparing device 1 applies ink A without processing the print data when original print data is used to apply ink A to the label piece 104 with uniform print density and when the peripheral inclined surfaces 101*a* has bad placement of ink A compared to the print surface 100*a* of the media 100, the print density of the peripheral part of the label piece 104 becomes low compared to the print density of an area other than the peripheral part. In contrast, even in such a case, it is possible for the label preparing device 1 according to the modification example to color the peripheral part of the label piece 104 with the same print density as in the area other than the peripheral part.

Meanwhile, it is not necessary for the label preparing device 1 to use a regular value as the overlap value, and the label preparing device 1 may acquire the overlap value from a database that combines a condition, such as the material of the label connection body 101 or the intensity of laser beams, which affects the width of the peripheral inclined surface 101*a*, with the overlap value (for example, a database in which the overlap value is set to 3 pixels in a case of a resin film and the overlap value is set to 1 pixel in a case of paper with regard to the material of the label connection body 101).

Similarly, it is not necessary for the label preparing device 1 to use a regular value as the density value, and the label preparing device 1 may acquire the density value from a database that combines a condition, such as the material of the label connection body 101 or the intensity of laser beams, which affects the details of the placement of ink A in the peripheral inclined surface 101*a*, with the density value (for example, a database in which the density value is set to an increase of 10% in a case of a resin film and the density value is set to an increase of 20% in a case of paper with regard to the material of the label connection body 101).

In addition, ink is not limited to ink A which includes CMYK colors. For example, when the label preparing device 1 applies another ink A, such as clear ink, which does not include color materials, or pre-coating liquid B, which will be described later, the label preparing device 1 may process the print data such that the print density of the peripheral part of the label piece 104 increases, in other words, such that the amount of applied ink A or pre-coating liquid B increases.

The label preparing device 1 may apply the pre-coating liquid B (refer to FIGS. 12A to 12D) to at least the peripheral part of the label piece 104 after the label piece 104 is formed by the laser cutting section 13 and before the print section 14 applies ink A. The pre-coating liquid B is used to form a pre-coated layer 111 (refer to FIGS. 13A to 13D) on the print surface 100*a* of the media 100. The pre-coated layer 111 accommodates ink A. The pre-coated layer 111 includes various functions of increasing the color development of ink A and increasing the scratch resistance of the print surface 100*a*.

In the modification example, the print section 14 includes pre-coating heads 55 (refer to FIGS. 12A to 12D), which discharge pre-coating liquid B, in addition to the recording heads 54 which discharge the CMYK ink A. Similarly to the recording heads 54, it is possible to suitably use the ink jet heads as the pre-coating heads 55.

Figure 11:
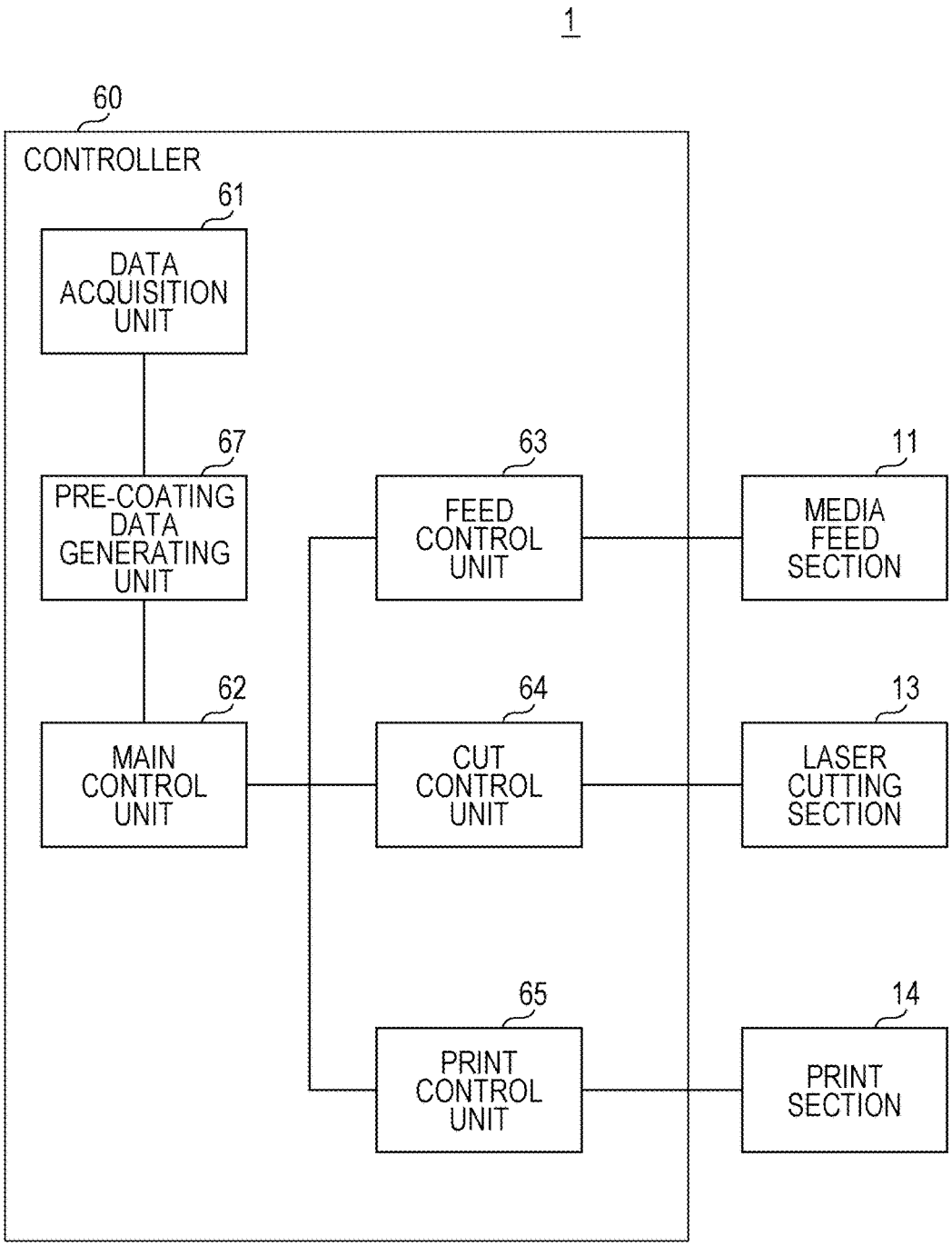
FIG. 11 is a control block diagram illustrating the label preparing device according to the modification example.

As illustrated in FIG. 11, the controller 60 includes a pre-coating data generation unit 67 in addition to the data acquisition unit 61, the main control unit 62, the feed control unit 63, the cut control unit 64, and the print control unit 65 which are described above. The pre-coating data generation unit 67 generates pre-coating data based on the print data such that the pre-coating liquid B is applied to at least a position where ink A is applied. For example, when the print data is used to apply ink A in a star shape, the pre-coating data is for applying the pre-coating liquid B to the media 100 in a star shape having the same shape and the same size. The print control unit 65 controls the print section 14 based on the generated pre-coating data.

An order that the label preparing device 1 according to the modification example prepares the printed label 106 on the media 100 will be described based on the difference from the above-described embodiment with reference to FIGS. 12A to 12D and FIGS. 13A to 13D. Meanwhile, here, the label connection body 101 has a laminated structure in which a film 107, paper 108, and the like are laminated (refer to FIGS. 13A to 13D). However, the label connection body 101 may have the above-described single layer structure.

Figure 12A:
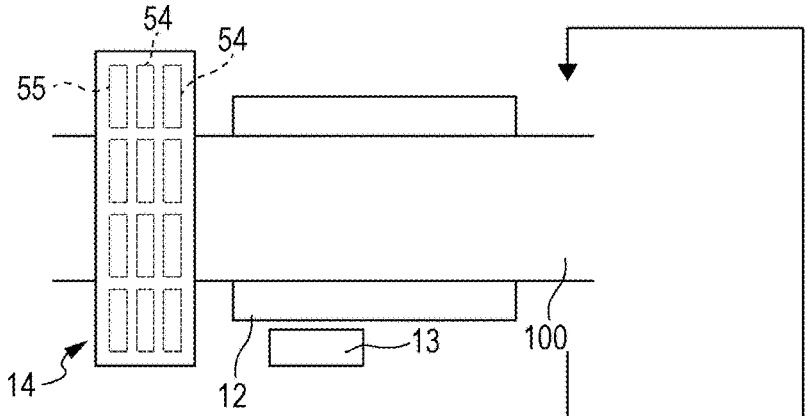
Figure 12B:
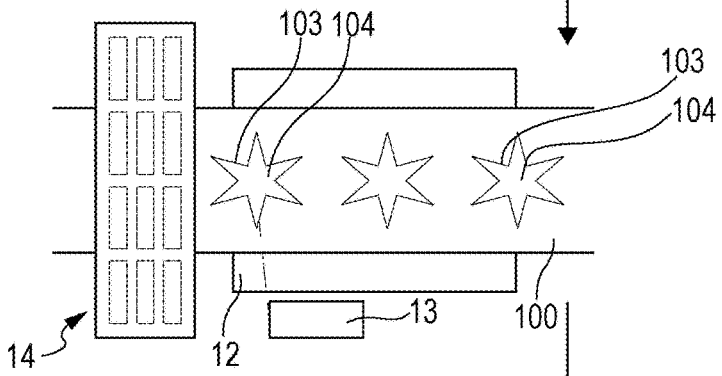
Figure 12C:
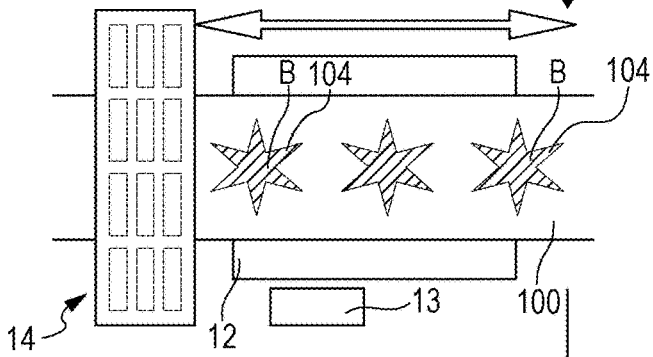
Figure 12D:
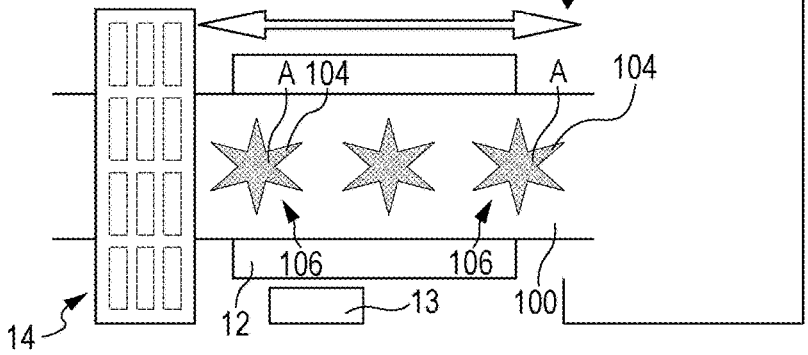
Figure 13A:
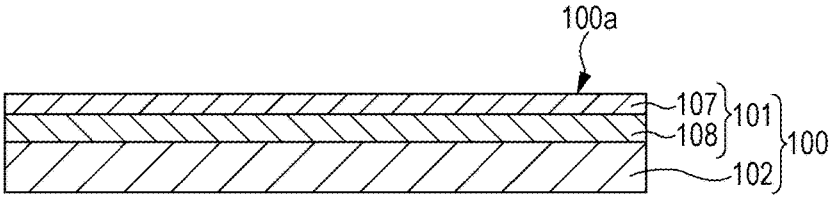
Figure 13B:
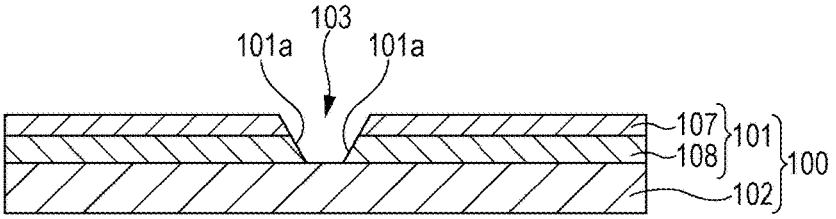
Figure 13C:
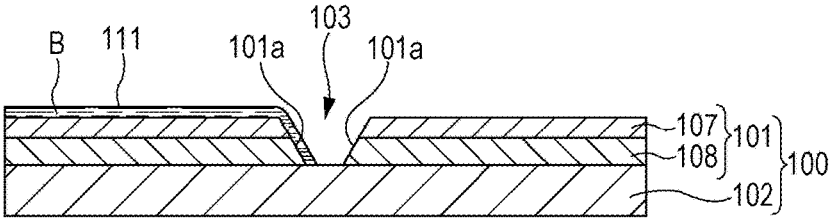
Figure 13D:
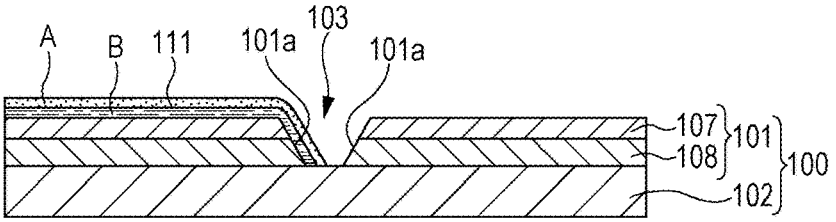
Figure 14A:
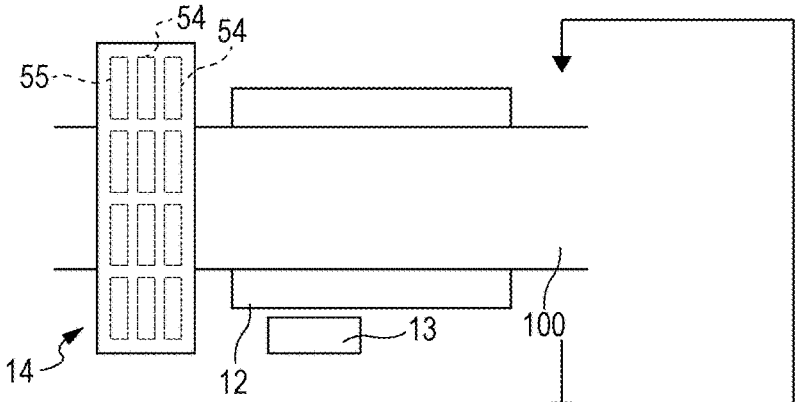
Figure 14B:
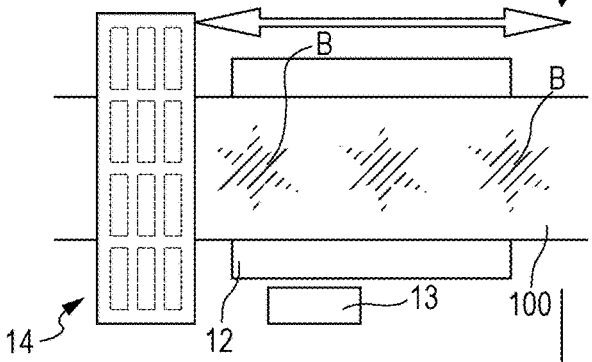
Figure 14C:
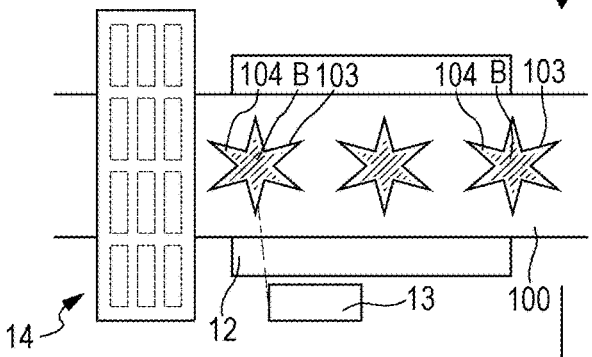
Figure 14D:
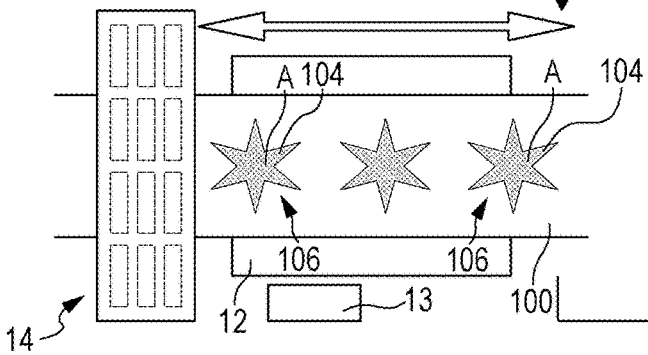
Figure 15A:
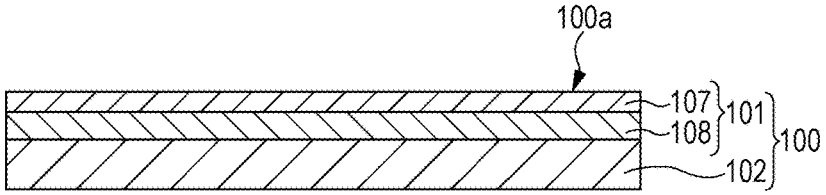
Figure 15B:
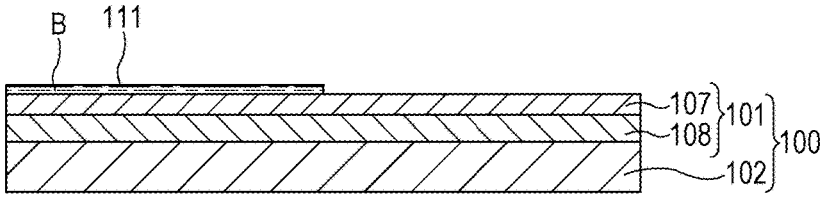
Figure 15C:
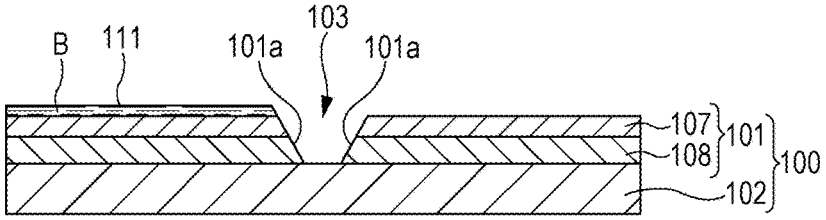
Figure 15D:
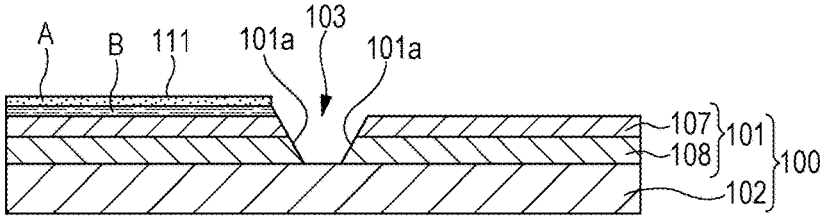
Figure 16A:
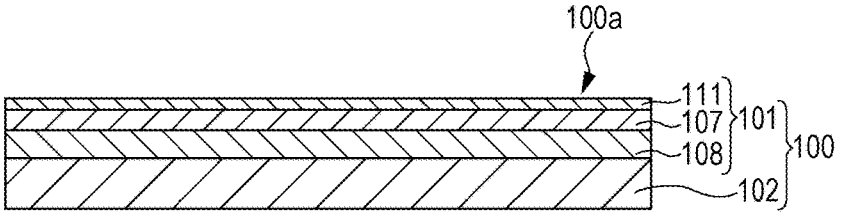
FIGS. 16A to 16D are sectional diagrams illustrating a media on which the cutting line is formed by the label preparing device, and are diagrams illustrating a modification example of a pre-coating liquid applying method.
Figure 16B:
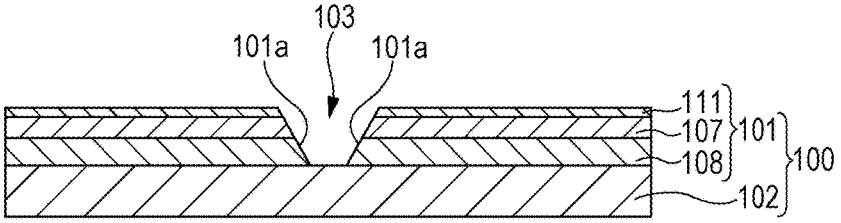
Figure 16C:
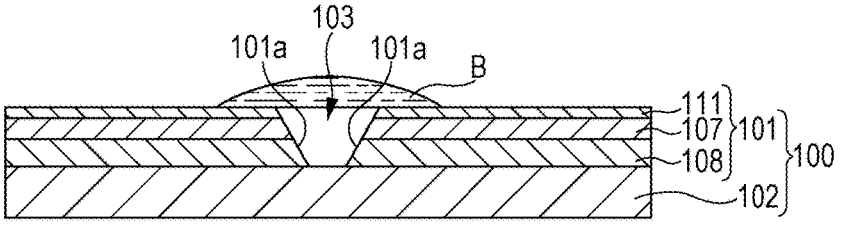
Figure 16D:
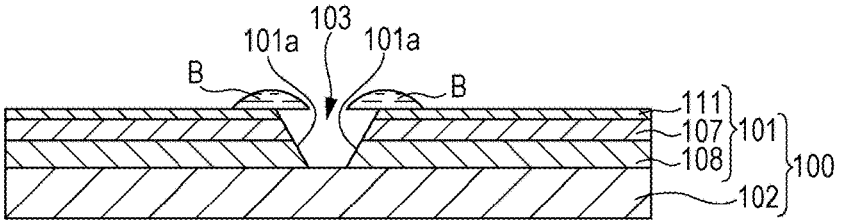

When the label preparing device 1 according to the modification example starts to prepare the printed label 106, the laser cutting section 13 forms the label piece 104 as illustrated in FIG. 12B, similarly to the above-described embodiment. Therefore, on both sides of the cutting line 103, the peripheral inclined surfaces 101*a* are formed in the label connection body 101 (refer to FIG. 13B). Subsequently, in the label preparing device 1, as illustrated in FIG. 12C, the print section 14 applies the pre-coating liquid B to the media 100 which is being adsorbed on the platen 12 unlike the embodiment. Here, the pre-coating data is generated such that the pre-coating liquid B is applied to positions to which ink A is applied. Therefore, the pre-coating liquid B is applied to the label piece 104 while including the peripheral part thereof, and thus the pre-coated layer 111 is formed (refer to FIG. 13C). Thereafter, in the label preparing device 1, the print section 14 applies ink A to the media 100 which is being adsorbed on the platen 12 as illustrated in FIG. 12D. That is, ink A is applied to the peripheral inclined surfaces 101*a* in a state in which the pre-coated layer 111 is formed (refer to FIG. 13D).

Unlike the modification example, a case in which the label preparing device 1 performs laser cutting (refer to FIG. 14C) after applying the pre-coating liquid B to the media 100 (refer to FIG. 14B) will be described with reference to FIGS. 14A to 14D and FIGS. 15A to 15D. In this case, in the peripheral inclined surfaces 101*a*, which are formed through laser irradiation, that is, in the peripheral parts of the label piece 104, the pre-coated layer 111 is removed (refer to FIG. 15C). Therefore, the label preparing device 1 applies ink A to the peripheral parts of the label piece 104 in a state in which the pre-coated layer 111 is not present (refer to FIG. 15D). An area in which the pre-coated layer 111 is not present has bad placement of ink A, and thus the peripheral parts of the label piece 104 is not appropriately colored.

In contrast, the label preparing device 1 according to the modification example applies the pre-coating liquid B to at least the peripheral parts of the label piece 104 after performing laser cutting, as described above. Therefore, the label preparing device 1 applies ink A to the peripheral parts of the label piece 104 in a state in which the pre-coated layer 111 is formed. Accordingly, it is possible for the label preparing device 1 to appropriately color the peripheral parts of the label piece 104.

A case, in which the printed label 106 is prepared on the media 100 in which the pre-coated layer 111 is formed on the print surface 100*a* in advance (refer to FIG. 16A), will be described with reference to FIGS. 16A to 16D. In this case, the pre-coated layer 111 corresponding to the peripheral parts of the label piece 104 is removed by laser irradiation (refer to FIG. 16B). However, the pre-coating liquid B may be applied to only the peripheral parts of the label piece 104. For example, the label preparing device 1 may apply the pre-coating liquid B focusing on the cutting line 103 (refer to FIG. 16C), and may apply the pre-coating liquid B focusing on the peripheral inclined surfaces 101*a* (refer to FIG. 16D).

It is possible for the laser cutting section 13 to form an arbitrary shaped label piece 104 while not being limited to the star-shaped label piece 104. Similarly, it is possible for the print section 14 to apply ink A to an arbitrary shape while not being limited to the star shape. In addition, it is not necessary for the shape of the label piece 104, which is formed by the laser cutting section 13, to be the same as the shape of ink A (the shape of an image) which is applied by the print section 14. That is, it is not necessary for the print section 14 to apply ink A to the entire label piece 104, and the print section 14 may apply ink A to at least the peripheral parts of the label piece 104. In addition, the print section 14 may apply ink A such that ink A is bulged from the cutting line.

The entire disclosure of Japanese Patent Application No. 2014-193677, filed Sep. 24, 2014 is expressly incorporated by reference herein.

What is claimed is:

1. A label preparing device comprising:

a laser cutting section that forms a cutting line, which is an outline of a label piece, on a media by irradiating the media with laser beams, wherein, while the cutting line is being formed, the media is secured in place by a suction fan;

a print section that applies ink to at least a peripheral part of the label piece after the cutting line is formed; and a platen, wherein the laser cutting section forms the cutting line on the media at a position of the platen, and wherein the print section applies the ink to the media in which the cutting line was formed at the same position of the platen.

2. The label preparing device according to claim 1, wherein the laser cutting section irradiates the media in an immobile state with laser beams, and wherein the print section applies ink to the media in which the immobile state is maintained.

3. The label preparing device according to claim 2, wherein the media, when in the immobile state, is placed on the platen, and wherein the laser cutting section forms the cutting line on the media, which includes a label connection body and a liner which is affixed to the label connection body, such that the label connection body is cut and the liner is not cut.

4. The label preparing device according to claim 1, further comprising:

a data acquisition unit that acquires print data; and a print data processing unit that processes the print data such that a print density of the peripheral part of the label piece increases, wherein the print section applies ink to the media based on the processed print data.

5. The label preparing device according to claim 1, wherein the print section applies pre-coating liquid for forming a pre-coated layer, which accommodates ink, to at least the peripheral part of the label piece after the label piece is formed by the laser cutting section and before ink is applied to the media.

6. A label preparing method comprising:

forming a cutting line, which is an outline of a label piece, on a media by irradiating the media with laser beams, wherein, while the cutting line is being formed, the media is secured in place by a suction fan, and wherein a laser cutting section forms the cutting line on the media at a position of a platen; and applying ink to at least a peripheral part of the label piece after the cutting line is formed, wherein the ink is applied at the same position of the platen.

* * * * *